US005661282A

United States Patent [19]

Tsuchiya et al.

[11] Patent Number: 5,661,282

[45] Date of Patent: Aug. 26, 1997

[54] GAS INSULATED CIRCUIT BREAKER

[75] Inventors: Kenji Tsuchiya; Goro Daimon; Kunio Hirasawa; Yuuichirou Yamane, all of Hitachi, Japan

[73] Assignee: Hitachi, Ltd., Tokyo, Japan

[21] Appl. No.: 402,826

[22] Filed: Mar. 13, 1995

[30] Foreign Application Priority Data

Mar. 18, 1995 [JP] Japan ..... 6-048260

[51] Int. Cl.[6] ..... H01H 33/16

[52] U.S. Cl. ..... 218/145

[58] Field of Search ..... 218/43, 44, 45, 218/68, 69, 71, 77, 79, 80, 143–145

[56] References Cited

U.S. PATENT DOCUMENTS

| | | | |
|---|---|---|---|
| 3,172,980 | 3/1965 | Thommen | 200/148 |
| 4,810,840 | 3/1989 | Okuno | 200/144 AP |
| 5,039,831 | 8/1991 | Sato et al. | 200/144 AP |
| 5,266,758 | 11/1993 | Pham et al. | 200/144 AP |
| 5,298,703 | 3/1994 | Yatsuzuka et al. | 200/148 R |

OTHER PUBLICATIONS

"Lesson for Electrical Qualification Test", Series 13, Substation, Published by Denki Shoin, 1981, pp. 102–158.

*Primary Examiner*—Cassandra C. Spyrou
*Assistant Examiner*—Michael A. Friedhofer
*Attorney, Agent, or Firm*—Fay, Sharpe, Beall, Fagan, Minnich & McKee

[57] ABSTRACT

Breaking poles (1) and (2) are respectively secured to respective conductor bodies (4) and (5) and electrically connected thereto, and the conductor bodies (4) and (5) are fixedly secured and connected to each other by an interpole insulating support body (3). Interpole capacitors (7) are accommodated in the respective side walls of the interpole insulating support body (3). These parts for the breaking portion are accommodated within a grounded metal container (19) together with insulating gas and are secured to an operating box (18) via an insulating support body (17). The breaking poles (1) and (2) are designed to be transmitted an actuating force from the operating box (18) via an actuating insulation rod (not shown) and perform a breaking/making operation.

14 Claims, 4 Drawing Sheets

GAS INSULATED CIRCUIT BREAKER

BACKGROUND OF THE INVENTION

The present invention relates to a gas insulated circuit breaker and, in particular, relates to a structure of a gas insulated circuit breaker of a type in which a capacitor, for suppressing a rate of rise of recovery voltage induced immediately after a current interruption, is connected between breaking poles of the circuit breaker.

A conventional circuit breaker of this type is explained in "Lesson for Electrical Engineer Qualification Test, Series 13, Substation" Published by Denki Shoin, 1981, pp102~158).

According to this lesson series and the like, it is understood that there is a demand to reduce the number of parts and the size of a circuit breaker by means of reducing breaking points thereof.

It is further understood that although the reduction of the breaking points contributes to the size reduction of the circuit breaker but requires an increase of interrupting capacity per breaking point and for this purpose many measures such as with regard to the structure of the breaking portion and the arc extinguish medium therefor have been hitherto developed.

SUMMARY OF THE INVENTION

An object of the present invention is to provide a large capacity gas insulated circuit breaker which can realize an increase of interrupting capacity per breaking point with a simple structure as well as facilitate the assembly work thereof.

The above object is achieved by a gas circuit breaker constituted by disposing within a metal container filled with an insulating gas a breaking portion having a stationary pole and movable pole and a capacitor electrically connected in parallel between the poles of the breaking portion and extending in opening and closing directions of the movable poles. The circuit breaker further comprises an interpole insulating support body supporting the stationary and movable poles of the breaking portion, and an insulating cylinder having a smaller dielectric constant than that of the interpole insulating support body and accommodating the capacitor. The insulating cylinder accommodating the capacitor is disposed in the interpole insulating support body.

The following functions and advantages are obtained according to the present invention.

Since the poles of the breaking portion of the circuit breaker are supported by the insulating body while maintaining a predetermined positional relationship therebetween, assembly work of the poles of the breaking portion is independently performed and the breaking portion including both the stationary and movable poles connected by the insulating body can be treated as an integrated unitary body. When the movable pole in the breaking portion is connected to an operating box via another insulating body, an adjustment work of breaking/making operation of the breaking portion can be easily performed.

If a rate of rise of recovery voltage generated between the breaking poles immediately after the circuit breaker has interrupted a fault current is large and the recovery of dielectric strength between the breaking poles can not catch up to the generated recovery voltage, the circuit breaker fails to interrupt the fault current. Therefore, if a rate of rise of the recovery voltage is reduced, an interruptable current by the circuit breaker can be increased. For this purpose, a capacitor is connected between the breaking poles. However, there is a small gap between the outer circumference of the capacitor and the inner circumferential wall of a cylindrical insulation sleeve accommodating the capacitor. A narrow area, where the small gap, an electrode for connecting the capacitor to the breaking portion and the cylindrical insulation sleeve accommodating the capacitor join, is called a triple junction. The electric field in the small gap portion locally concentrates under the influence of the dielectric constant of the cylindrical insulation sleeve to induce an intense electric field therein. The magnitude of the intense electric field generated at the small gap portion in the triple junction generally tends to be proportional to the dielectric constant of the adjoining cylindrical insulation sleeve. Since the load of the breaking poles and impact load caused during the operation of the breaking portion directly act on the interpole insulating support body, the interpole insulating support body has to have sufficient mechanical strength to withstand these loads. An insulating material having a large mechanical strength tends to have a large dielectric constant. Therefore, if without directly accommodating the interpole capacitor into the interpole insulating support body having a large dielectric constant the interpole capacitor is first accommodated in a small cylindrical insulation sleeve having a small dielectric constant and then the interpole capacitor, accommodated in the small cylindrical insulation sleeve, is accommodated into the interpole insulating support body, the electric field concentration in the small gap can be relaxed.

DETAILED DESCRIPTION OF PREFERRED EMBODIMENTS

Figure 1:
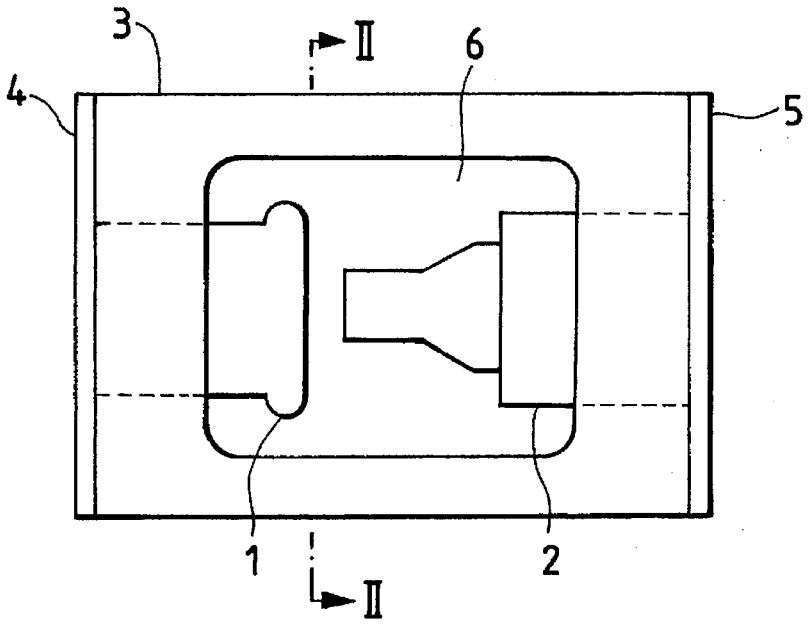
FIG. 1 is a plane view illustrating the breaking portion of an embodiment according to the present invention.

The embodiments according to the present invention will now be explained with reference to FIG. 1 through FIG. 6.

Breaking poles 1 and 2 are respectively secured to respective conductor bodies 4 and 5 and electrically connected thereto, and the conductor bodies 4 and 5 are fixedly secured and connected to each other by an interpole insulating support body 3. Interpole capacitors 7 are accommodated in the respective side walls of the interpole insulating support body 3. These parts for the breaking portion are accommodated within a grounded metal container 19 together with insulating gas and are all together secured to an operating box 18 via an insulating support body 17. The breaking poles 1 and 2 are designed to be translated of an actuating force from the operating box 18 via an actuating insulation rod (not shown) and perform a breaking/making operation.

Figure 2:
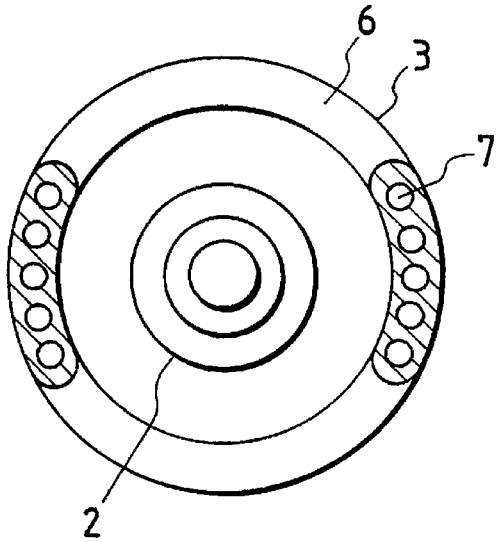
FIG. 2 is a cross sectional view taken along the line II—II in FIG. 1.

FIG. 1 shows a plane view of the breaking portion of the gas insulated circuit breaker having the above explained constitution wherein the breaking poles 1 and 2 are disposed in such a manner that the operating axis thereof runs substantially horizontally. FIG. 2 shows a cross sectional view taken along the line II—II in FIG. 1. As seen from these drawings, the conductor bodies 4 and 5 and the breaking poles 1 and 2 are integrated by the interpole insulating support body 3 such that these parts for the breaking portion can be treated as a unit. Further, the interpole insulating support body 3 is configurated in a cylindrical shape and is designed to accommodate the breaking poles 1 and 2 therein such that the entire size of the breaking portion can be reduced while maintaining a sufficient mechanical strength of the interpole insulating support body 3. Still further, the interpole insulating support body 3 is provided with openings 6 at its vertical direction such that maintenance, inspection and exchange of the breaking poles 1 and 2 are easily performed through the openings 6. Also, accumulation of decomposed materials of the insulating gas produced between the breaking poles 1 and 2 by an arcing heat caused during current interrupting operation on the inner face of the cylindrical interpole insulating support body 3 is prevented. The discomposed materials are powder-like insulating materials having a high hygroscopic property, therefore when the decomposed materials are exposed to outside air during, for example, inspection of the breaking portion and thus absorbs water in the outside air, the dielectric strength along the surface of the cylindrical interpole insulating support body 3 on which the decomposed materials absorbing water are deposited is likely reduced. However, with the provision of the openings 6, such a drawback is prevented. In order to provide the openings 6 in vertical direction of the interpole insulating support body 3, the interpole capacitors 7 are disposed in the respective side walls of the interpole insulating support body 3.

Figure 3:
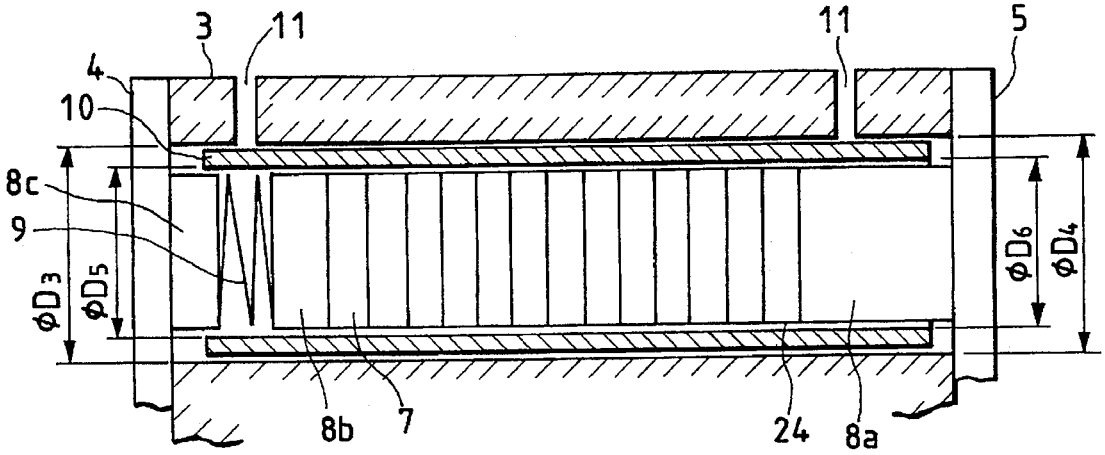
FIG. 3 is an enlarged cross sectional view of an interpole capacitor in an embodiment as shown in FIG. 1 and FIG. 2.

FIG. 3 is a cross sectional view illustrating a state wherein one of the interpole capacitors 7 is accommodated in the side walls of the interpole insulating support body 3. In a cylindrical hole formed along the side wall of the interpole insulating support body 3 the interpole capacitor 7 accommodates in a cylindrical insulating sleeve 10 is disposed coaxially with the cylindrical hole, and electrodes 8*a*, 8*b* and 8*c* for the interpole capacitor 7 are all together disposed. The interpole capacitor 7 is pressed toward the conductor bodies 4 and 5 and electrically connected thereto by a conductive spring a via the electrodes 8*a*, 8*b* and 8*c* for the capacitor 7. In the present embodiment, the diameters $\Phi D_3$ and $\Phi D_4$ at both ends of the hole formed in the interpole insulating support body 3 are differentiated and an inclination is provided for the cylindrical hole surface. Thus, the cylindrical hole can be formed simultaneously with the interpole insulating support body 3 in one piece during the molding process by making use of a proper trimming die which is very advantageous with respect to the manufacturing thereof. For the same reason, the diameters $\Phi D_5$ and $\Phi D_6$ at both ends of the hole of the cylindrical insulating sleeve 10 are differentiated and an inclination is provided for the cylindrical hole surface, thereby production of the cylindrical insulating sleeve 10 by one-piece molding is enabled. Further, through formation of through holes 11 extending from the outer circumferential face of the interpole insulating support body 3 into the capacitor accommodating hole, the insulating gas can be introduced into the capacitor accommodating hole. The interpole insulating support body 3 is generally formed by epoxy resin or FRP such that the dielectric constant thereof is as high as 4~6. Therefore, the interpole capacitor 7 is once accommodated in the cylindrical insulating sleeve 10. Since this cylindrical insulating sleeve 10 is not required to be a high mechanical strength, the cylindrical insulating sleeve 10 is formed of a material having a low dielectric constant such as tetrafluoroethylene. Thereby, the local electric field concentration in a small air gap 24 between the interpole capacitor 7 and the cylindrical insulating sleeve 10 and near at the capacitor use electrodes 8*a*, 8*b* and 8*c* is relaxed. Further, the cylindrical insulating sleeve 10 can be formed by wrapping a thin insulating plate around the outer circumference of the interpole capacitor 7 with substantially the same advantages.

As a further alternative, the interpole capacitor 7, the capacitor use electrodes 8*a*, 8*b* and 8*c*, the conductive spring 9 and the cylindrical insulating sleeve 10 accommodating these parts can be disposed around the outer circumferential face of the interpole insulating support body 3 while electrically connecting the capacitor use electrodes 8*a* and 8*c* to the respective conductor bodies 4 and 5 with substantially the advantages. The principle of the above is explained hereinbelow with reference to FIG. 4.

Figure 4:
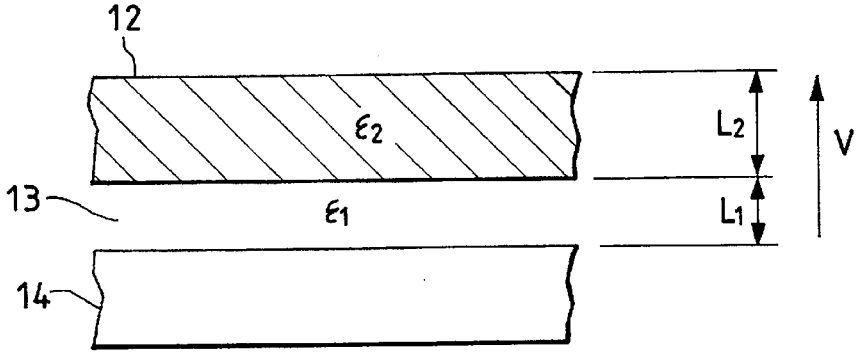
FIG. 4 is a schematic diagram for explaining a triple junction which occurs in the embodiment as shown in FIG. 3.

The portion, where the small air gap 24, the capacitor use electrode 8*a* or 8*b* and the cylindrical insulating sleeve 10 join, is called as triple junction as indicated previously. FIG. 4 schematically illustrates a triple junction in which there exists a small air gap 13 between an electrode 14 and a dielectric substance 12. When assuming that the dielectric constants of the air gap 13 and the dielectric substance are respectively $\epsilon_1$ and $\epsilon_2$, the thicknesses thereof are respectively $L_1$ and $L_2$ and a potential difference V is applied between the electrode 14 and the dielectric substance 12. The electric field intensity $E_1$ in the air gap 13 and the electric field intensity $E_2$ in the dielectric substance 12 are expressed as follows;

$$E_1=\epsilon_2 V/(L_2\epsilon_1+L_1\epsilon_2)$$

$$E_2=\epsilon_1 V/(L_2\epsilon_1+L_1\epsilon_2)$$

From the above equations, it will be understood that the electric field intensity $E_1$ in the air gap 13 varies in proportion to the magnitude of the dielectric constant of the dielectric substance 12. Accordingly, if the dielectric constant of the dielectric substance 12 is reduced, the electric field concentration in the air gap 13 can be relaxed. For this reason when a cylindrical insulating sleeve 10 having a low dielectric constant corresponding to the dielectric substance 12 is used, the electric field concentration relaxing effect can be achieved. Further, since the respective elements of the interpole capacitor 7 uniformly share the potential applied between the poles, therefore if both center points in the axial direction (direction of an arrow B) of the breaking poles 1 and 2 and the interpole capacitor 7 are designed to substantially coincide each other, an extreme electric field concentration either at the breaking pole 1 or 2 is prevented, thereby the insulation performance of the interpole insulating support body 3 is greatly improved.

Figure 6:
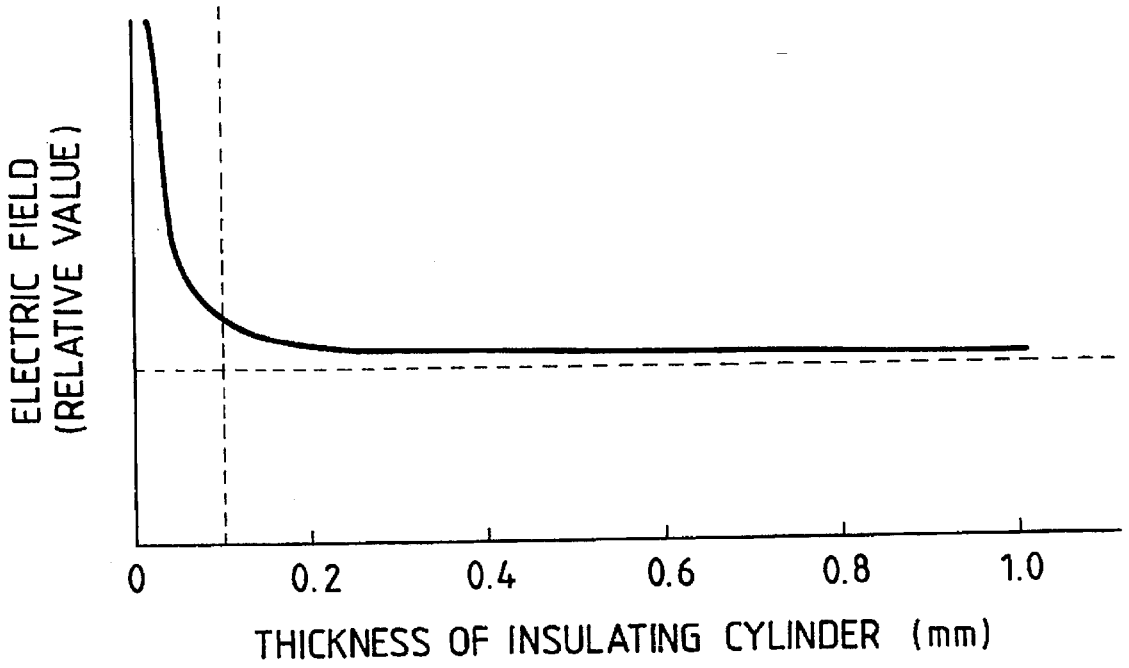
FIG. 6 is a graph illustrating a relationship between thickness of a cylindrical insulation sleeve accommodating the interpole capacitor and electric field at electric field concentration portion on the interpole capacitor.

For fully enjoying the above electric field concentration relaxing effect in an actual circuit breaker it is necessary to select a cylindrical insulating sleeve 10 having a thickness of above a predetermined value. FIG. 6 illustrates a relationship between electric field intensity at the electric field concentrating portion on the capacitor 7 and thickness of the cylindrical insulating sleeve 10. The electric field intensity in FIG. 6 is represented by relative value when the thickness of the cylindrical insulating sleeve is sufficient. It is understood from the illustration in FIG. 6 that with the cylindrical insulating sleeve 10 having a thickness of more than 0.1 mm the electric field concentration is sufficiently relaxed. Accordingly, if the thickness of the cylindrical insulating sleeve 10 is selected to be more than 0.1 mm, the electric field concentration is relaxed and the dielectric strength of the interpole insulating support body 3 is improved. Although the thicker the thickness of the cylindrical insulating sleeve 10 the more the electric field concentration is relaxed, however the degree of electric field concentration relaxation with the thickness more than 10 mm is below 0.1%. Further, when the thickness of the cylindrical insulating sleeve 10 is determined to be more than 10 mm, the diameter of the hole formed in the interpole insulating support body 3 for receiving the cylindrical insulating sleeve 10 accommodating the capacitor 7 has to be excessively enlarged which causes reduction in the mechanical strength of the interpole insulating support body 3. Accordingly, it is preferable to select the thickness of the cylindrical insulating sleeve 10 to be less than 10 mm.

Figure 5:
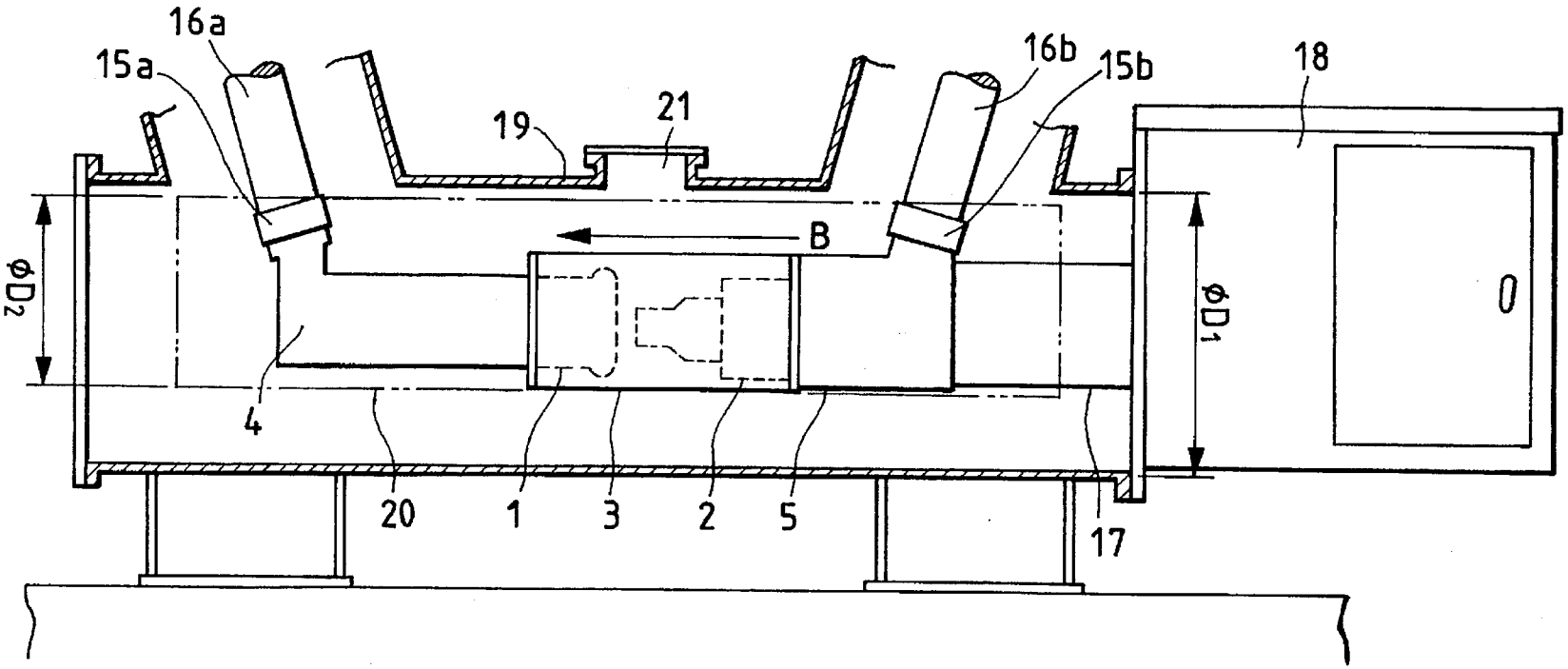
FIG. 5 is a cross sectional view illustrating the gas insulated circuit breaker of the embodiment according to the present invention.

FIG. 5 is a cross sectional view of a gas circuit breaker according to the present invention. The breaking unit connected by the interpole insulating support body 3 is connected to the operating box 18 via the insulating support body 17. On the conductor bodies 4 and 5 respective current collectors 15*a* and 15*b* are secured and to which respective branching conductors 16*a* and 16*b* are connected, for part of which illustration is omitted. With the connection of the breaking unit to the operating box 18 via the insulating support body 17 an adjustment of the breaking/making operation of the breaking poles 1 and 2 is permitted before assembling the breaking unit into the metal container 19 which greatly improves the work efficiency. Further, when the diameter $\Phi D_2$ of an imaginary cylinder 20 inscribing the assembly of the breaking portion including the current collectors 15*a* and 15*b* is selected smaller than the diameter $\Phi D_1$ at the end face of the metal container 19 where the breaking portion is inserted and the height of the imaginary cylinder 20 is selected not to touch the cylindrical wall portion of the metal container 19, the breaking unit containing the current collectors 15*a* and 15*b* can be inserted linearly into the direction indicated in an arrow B under the condition being connected to the operating box 18 which also greatly improves the assemblying efficiency. Still further, with the provision of a hand hole 21 on the surface of the metal container 19 in the direction facing to the openings 6 of the interpole insulating support body 3, the adjustment, maintenance and inspection of the breaking portion from the outside of the metal container 19 is facilitated.

According to the present invention, a gas circuit breaker having a high insulating performance and a large current interrupting capacity per one breaking point is realized with a simple structure and the assembling work efficiency therefor is improved.

We claim:

1. A gas insulated circuit breaker including a breaking portion having a stationary pole and a movable pole disposed within a metal container filled with an insulating gas and a capacitor electrically connected in parallel between the stationary and movable poles of said breaking portion and extending in opening and closing directions of the movable pole, the gas insulated circuit breaker comprising: an interpole insulating support body supporting the stationary and movable poles of said breaking portion, and an insulating sleeve having a smaller dielectric constant than that of said interpole insulating support body for accommodating said capacitor disposed along said interpole insulating support body wherein said interpole insulating support body is configured in a substantially cylindrical shape and the stationary and movable poles are accommodated in the insulating support body; and wherein said stationary and movable poles are disposed in such a manner that breaking/making operation axis runs substantially horizontally, said capacitor accommodated in said insulating sleeve is disposed in a side wall of said interpole insulating support body and further an opening extending in vertical direction is provided on said interpole insulating support body.

2. A gas insulated circuit breaker according to claim 1, wherein a thickness of said insulating sleeve for accommodating said capacitor is selected to be more than 0.1 mm and less than 10 mm.

3. A gas insulated circuit breaker according to claim 2, wherein said insulating sleeve for accommodating said capacitor is formed of a fluorocarbon resin.

4. A gas insulated circuit breaker according to claim 1, wherein said insulating sleeve for accommodating said capacitor is formed of a fluorocarbon resin.

5. A gas insulated circuit breaker according to claim 1, wherein said insulating sleeve for accommodating said capacitor is constituted by wrapping a thin insulating plate around an outer circumference of said capacitor.

6. A gas insulated circuit breaker according to claim 1, wherein a hand hole is provided at a surface of the metal container facing to the opening formed at said interpole insulating support body.

7. A gas insulated circuit breaker according to claim 6, wherein a diameter at an end opening of the metal container accommodating said breaking portion and current collectors is selected to be larger than an imaginary cylinder inscribing the breaking portion to which the current collectors are secured.

8. A gas insulated circuit breaker including a breaking portion having a stationary pole and a movable pole disposed within a metal container filled with an insulating gas and a capacitor electrically connected in parallel between the stationary and movable poles of said breaking portion and extending in opening and closing directions of the movable pole, the gas insulated circuit breaker comprising: an interpole insulating support body supporting the stationary and movable poles of said breaking portion, and an insulating sleeve having a smaller dielectric constant than that of said interpole insulating support body for accommodating said capacitor disposed along said interpole insulating support body wherein said interpole insulating support body is configured in a substantially cylindrical shape and the stationary and movable poles are accommodated in the insulating support body; and wherein a hole for receiving said insulating sleeve for accommodating said capacitor is formed along said interpole insulating support body and a further through-hole extending from an outer circumferential surface of said interpole insulating support body to an inside of said hole is provided.

9. A gas insulated circuit breaker according to claim 8, wherein a thickness of said insulating sleeve for accommodating said capacitor is selected to be more than 0.1 mm and less than 10 mm.

10. A gas insulated circuit breaker according to claim 9, wherein said insulating sleeve for accommodating said capacitor is formed of a fluorocarbon resin.

11. A gas insulated circuit breaker according to claim 8, wherein said stationary and movable poles supported by said interpole insulating support body and said capacitor are disposed in such a manner that a center of each of said stationary and movable poles and said capacitor taken along an axial direction thereof are located at substantially a same axial position.

12. A gas insulated circuit breaker including a breaking portion having a stationary pole and a movable pole disposed within a metal container filled with an insulating gas and a capacitor electrically connected in parallel between the stationary and movable poles of said breaking portion and extending in opening and closing directions of the movable pole, the gas insulated circuit breaker comprising: an interpole insulating support body supporting the stationary and movable poles of said breaking portion, and an insulating sleeve having a smaller dielectric constant than that of said interpole insulating support body for accommodating said capacitor disposed along said interpole insulating support body wherein said interpole insulating support body is configured in a substantially cylindrical shape and the stationary and movable poles are accommodated in the insulating support body; and wherein a hole for receiving said insulating sleeve accommodating said capacitor formed in said interpole insulating support body is configured in a substantially cylindrical shape and is provided with two ends having diameters that are different from each other.

13. A gas insulated circuit breaker according to claim 12, wherein said insulating sleeve for accommodating said capacitor is configured in a substantially cylindrical shape and is provided with two ends having inner diameters that are different from each other.

14. A gas insulated circuit breaker according to claim 12, wherein one pole end of said breaking portion is supported and connected via an insulating body to an operating box accommodating an operating mechanism for operating said breaking portion.

* * * * *